US010534300B2

(12) United States Patent
Suzuki

(10) Patent No.: US 10,534,300 B2
(45) Date of Patent: Jan. 14, 2020

(54) IMAGE FORMING APPARATUS AND IMAGE FORMING METHOD

(71) Applicants: KABUSHIKI KAISHA TOSHIBA, Tokyo (JP); TOSHIBA TEC KABUSHIKI KAISHA, Tokyo (JP)

(72) Inventor: Akitoshi Suzuki, Mishima Shizuoka (JP)

(73) Assignees: KABUSHIKI KAISHA TOSHIBA, Tokyo (JP); TOSHIBA TEC KABUSHIKI KAISHA, Tokyo (JP)

( * ) Notice: Subject to any disclaimer, the term of this patent is extended or adjusted under 35 U.S.C. 154(b) by 59 days.

(21) Appl. No.: 15/875,856

(22) Filed: Jan. 19, 2018

(65) Prior Publication Data

US 2018/0329349 A1 Nov. 15, 2018

(30) Foreign Application Priority Data

May 9, 2017 (JP) ..... 2017-092964

(51) Int. Cl.
*G03G 15/00* (2006.01)
*G03G 15/20* (2006.01)

(52) U.S. Cl.
CPC ..... *G03G 15/5062* (2013.01); *G03G 15/2039* (2013.01)

(58) Field of Classification Search
CPC ..... G03G 15/2025; G03G 15/2039; G03G 15/205; G03G 15/5058; G03G 15/5062; G03G 15/6585; G03G 21/00; G03G 2215/00531
See application file for complete search history.

(56) References Cited

U.S. PATENT DOCUMENTS 9,342,029 B1 * 5/2016 Tabata ..... G03G 15/6585
2008/0199197 A1 * 8/2008 Suzuki ..... G03G 15/2025 399/67

(Continued)

FOREIGN PATENT DOCUMENTS

JP 2006345367 A 12/2006
JP 2013235166 A 11/2013

OTHER PUBLICATIONS

Diane M. Weeden, Cut Sheet Purge and Fuser Clean Method, Xerox Disclosure Journal, vol. 23, No. 1, Jan. 1, 1998, p. 25.

(Continued)

*Primary Examiner* — Gregory H Curran
(74) *Attorney, Agent, or Firm* — Kim & Stewart LLP

(57) ABSTRACT

An image forming apparatus includes a first toner image forming unit for forming first toner image on a transfer belt with a first toner and a second toner image forming unit for forming a second toner image on the transfer belt with a second toner. A secondary transfer unit transfers the first and second toner images from the transfer belt to a sheet traveling in a sheet transport direction. A fixing unit fixes the first and second toner images to the sheet. A control unit controls the first toner image forming unit to form a first pattern, the second toner image forming unit to form a second pattern, and to leaving a margin on a upstream side of the sheet in the sheet transport direction that is greater than or equal to a circumferential distance of a fixing element in the fixing unit.

11 Claims, 12 Drawing Sheets

(56) References Cited

U.S. PATENT DOCUMENTS

| | | | | |
|---|---|---|---|---|
| 2010/0260523 | A1* | 10/2010 | Nishida | G03G 15/2025 399/327 |
| 2014/0064747 | A1 | 3/2014 | Numazu | |
| 2015/0378289 | A1 | 12/2015 | Kinouchi et al. | |
| 2016/0041511 | A1 | 2/2016 | Fujii et al. | |

OTHER PUBLICATIONS

Extended European Search Report dated Jul. 27, 2018, mailed in counterpart European Application No. 18169022.3, 12 pages.

* cited by examiner

IMAGE FORMING APPARATUS AND IMAGE FORMING METHOD

CROSS-REFERENCE TO RELATED APPLICATION

This application is based upon and claims the benefit of priority from Japanese Patent Application No. 2017-092964, filed May 9, 2017, the entire contents of which are incorporated herein by reference.

FIELD

Embodiments described herein relate generally to an image forming apparatus and an image forming method.

BACKGROUND

In recent years, an image forming apparatus which performs printing using decolorable toner has been developed. In such an apparatus, the decolorable toner and normal toner, which cannot be decolored, are used for different purposes.

In the image forming apparatus in which different types of toner are used in this manner, a predetermined test pattern will be printed on a sheet in order to check whether or not images formed by each toner type is being printed at a proper, intended position on the sheet.

However, in the image forming apparatus in which decolorable toner is used, when a test pattern is formed of both the decolorable toner and normal toner, there is a case in which a toner image formed using the decolorable toner becomes transparent due to heating associated with the fixing of the normal toner, which, generally, has a fixing temperature that is relatively high.

On the other hand, when fixing a test pattern to a sheet according to an appropriate fixing temperature of the decolorable toner, there is a case in which the fixing of the normal toner (which generally has a higher fixing temperature) is insufficient. In such a case, a transfer member of a transfer device will be contaminated due to the normal toner being separated from a sheet because of insufficient fixing, and as a result, a quality of an image formed on the sheet deteriorates.

DETAILED DESCRIPTION

According to an embodiment, an image forming apparatus includes a first toner image forming unit configured to form a first toner image on a transfer belt using a first toner that fixes at a first temperature and a second toner image forming unit configured to form a second toner image on the transfer belt using a second toner that fixes at a second temperature that is different from the first temperature. A secondary transfer unit is configured to transfer the first and second toner images from the transfer belt to a sheet traveling in a sheet transport direction. A fixing unit is configured to fix the first and second toner images to the sheet traveling in the sheet transport direction. A control unit is configured to: control the first toner image forming unit to form the first toner image in a first pattern on the transfer belt; control the second toner image forming unit to form the second toner image in a second pattern on the transfer belt overlapping the first pattern; and to control, the secondary transfer unit to transfer the first pattern and the second pattern onto the sheet while leaving a margin (un-patterned region) on a upstream side of the sheet in the sheet transport direction. A length of the margin in the sheet transport direction is greater than or equal to a circumferential distance of a fixing element in the fixing unit.

Figure 1:
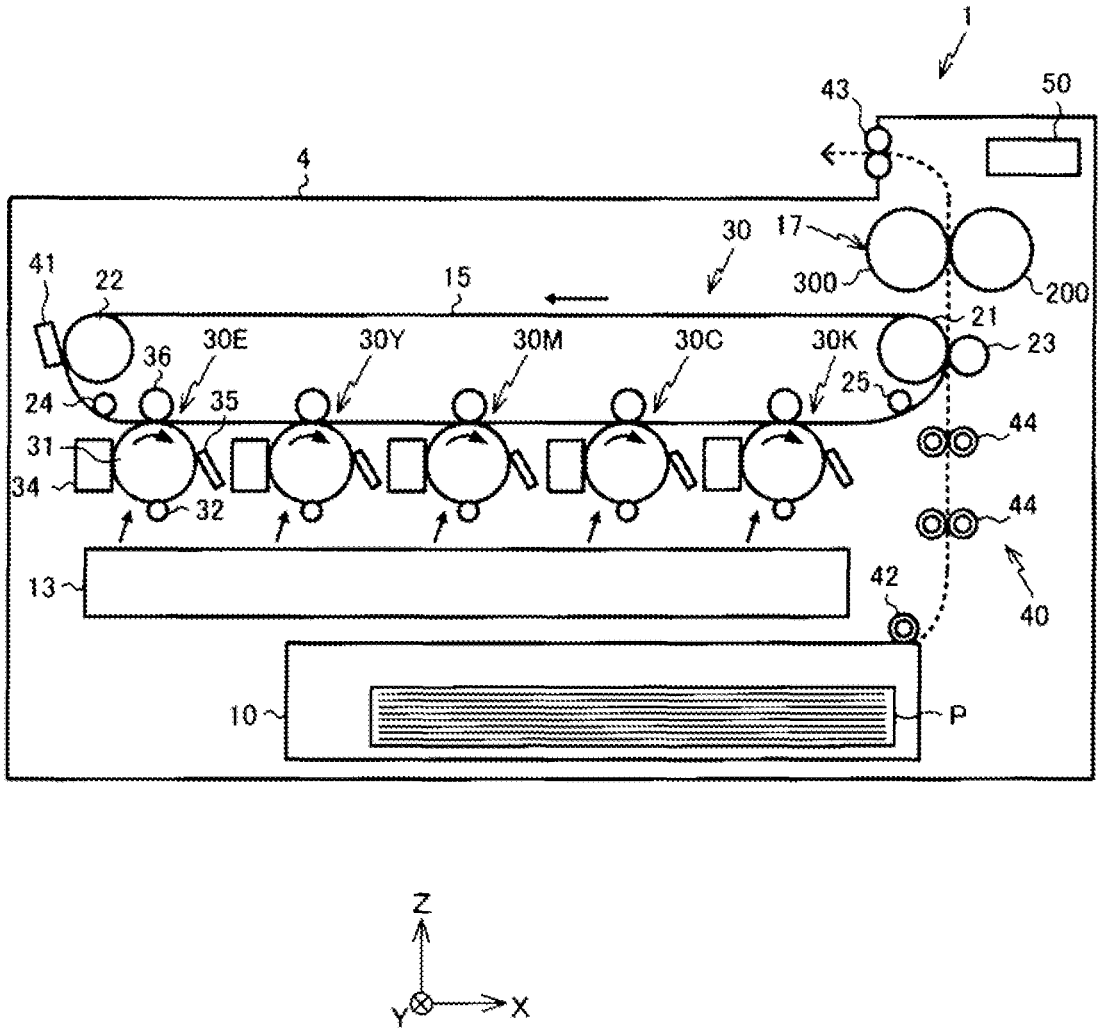
FIG. 1 is a diagram which illustrates a configuration example of an image forming apparatus according to an embodiment.

Hereinafter, an example embodiment of the disclosure will be described with reference to drawings. FIG. 1 is a diagram which illustrates a configuration example of an image forming apparatus 1 according to the embodiment. The image forming apparatus 1 is a color laser printer in which decolorable blue toner is used, in addition to normal-type toner of yellow, magenta, cyan, and black. The image forming apparatus 1 is provided with a housing 4, and an image forming unit 30, a laser exposure device 13, a paper feeding cassette 10, a control device 50, and a fixing device 17, which are accommodated in the housing 4.

The housing 4 is a parallelepiped casing which is formed of a resin material or the like, and a paper discharge unit is formed on a top face thereof.

As illustrated in FIG. 1, the image forming unit 30 has five image forming stations 30E, 30Y, 30M, 30C, and 30K, and a transfer belt 15.

The image forming stations 30E, 30Y, 30M, 30C, and 30K are each respectively provided with a photoconductive drum 31. A charging device 32, a developing device 34, and a cleaner 35 are disposed at the periphery of each photoconductive drum 31. The photoconductive drums 31 of the image forming stations 30E, 30Y, 30M, 30C, and 30K rotate to the right side toward the +Y direction, as denoted by an arrow.

The surface of each photoconductive drum 31 is charged by a respective charging device 32. Laser light output from the laser exposure device 13 is radiated to the surface of the respective photoconductive drums 31. In this manner, an electrostatic latent image is formed on the surface of the photoconductive drum 31.

The developing device 34 includes a developer which is formed of toner of one of blue (E), yellow (Y), magenta (M), cyan (C), and black (K) mixed with a carrier. The toner for yellow (Y), magenta (M), cyan (C), and black (K) are toners having as a main component a non-decoloring pigment, and are thus non-decolorable (normal) toner in which the color does not substantially changes due to a temperature change within the relevant operating range. The blue (E) toner is decolorable toner of which a main component is a leuco dye. The decolorable toner changes so as to be transparent from the blue color when heated above some temperature. Thus, fixing temperatures of the normal toners and the decolorable toner are different, respectively.

Figure 2:
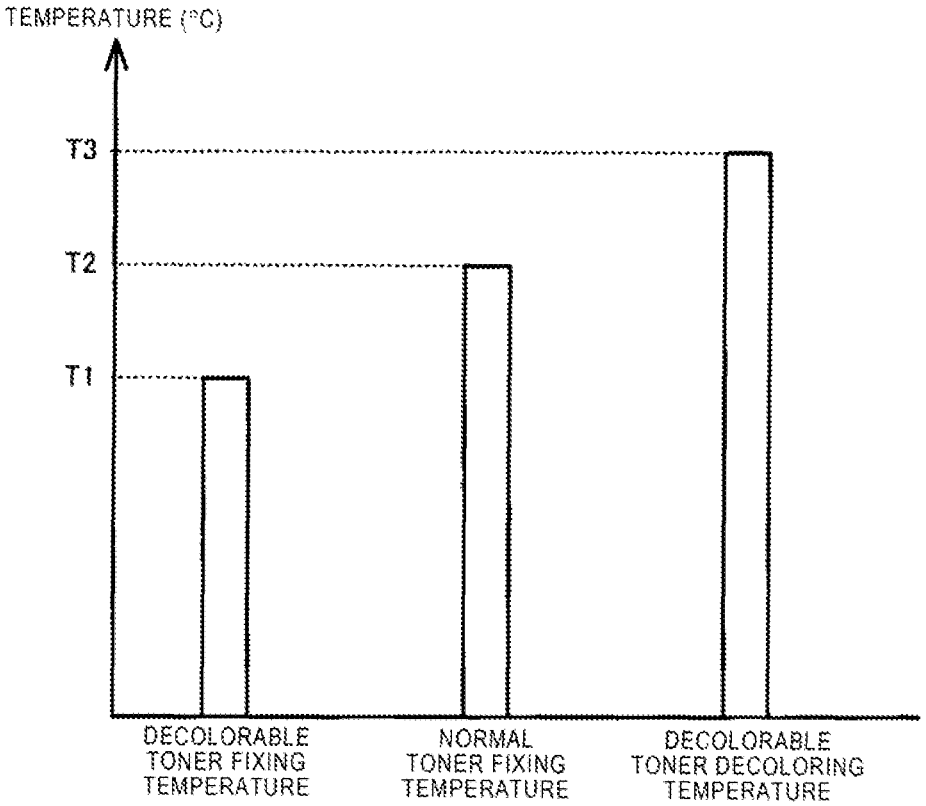
FIG. 2 is a diagram which conceptually illustrates a relationship among a fixing temperature of normal toner, a fixing temperature of decolorable toner, and a decoloring temperature of the decolorable toner.

FIG. 2 is a diagram which conceptually illustrates a relationship among a fixing temperature T2 of a normal toner, a fixing temperature T1 of a decolorable toner, and a decoloring temperature T3. The fixing temperature is a temperature applied when fixing toner onto a sheet by baking the toner. The decoloring temperature is a temperature at which the decolorable toner becomes decolored and changes to be transparent. As illustrated in FIG. 2, the fixing temperature T1 of the decolorable toner is lower than the fixing temperature T2 of the normal toner, and the decoloring temperature T3 of the decolorable toner is higher than the fixing temperature T2 of the normal toner. For example, the fixing temperature T1 of the decolorable toner may be approximately 100° C., and the decoloring temperature may be approximately 120° C. In such an example, the fixing temperature of the normal toner may be approximately 110° C.

Returning to FIG. 1, the developing device 34 supplies toner to a top face of the photoconductive drum 31. In this manner, a toner image of blue (E) is developed in the photoconductive drum 31 of the image forming station 30E. Similarly, a toner image of yellow (Y) is developed in the photoconductive drum 31 of the image forming station 30Y. A toner image of magenta (M) is developed in the photoconductive drum 31 of the image forming station 30M. A toner image of cyan (C) is developed in the photoconductive drum 31 of the image forming station 30C. A toner image of black (K) is developed in the photoconductive drum 31 of the image forming station 30K.

The transfer belt 15 is wound around a driving roller 21, a driven roller 22, and tension rollers 24 and 25. The transfer belt 15 is pushed to the photoconductive drum 31 of the respective image forming stations 30E, 30Y, 30M, 30C, and 30K, by a primary transfer roller 36 of the respective image forming stations 30E, 30Y, 30M, 30C, and 30K. In addition, a secondary transfer roller 23 is disposed in the vicinity of the driving roller 21.

In the image forming unit 30, toner images formed on the photoconductive drum 31 of the respective image forming stations 30E, 30Y, 30M, 30C, and 30K are sequentially transferred to the transfer belt 15 when the transfer belt 15 rotates in a direction denoted by an arrow due to a rotation of the driving roller 21. At this time, any toner remains on the surface of the photoconductive drum 31 is cleaned by the cleaner 35.

The paper feeding cassette 10 is detachably provided with respect to the housing 4. A sheet P, functioning as a recording medium on which an image can be formed, is accommodated in the paper feeding cassette 10.

The sheet P is transported from the paper feeding cassette 10 by a transport system 40, which includes a pickup roller 42, a resist roller 44, and a paper discharge roller 43. Specifically, the sheet P is extracted from the paper feeding cassette 10 by the pickup roller 42. The sheet P extracted from the paper feeding cassette 10 is then transported to between the transfer belt 15 and the secondary transfer roller 23, using the resist roller 44. When the sheet P reaches the paper discharge roller 43 through the fixing device 17, the sheet P is discharged to a paper discharge unit which is formed in the housing 4 by the paper discharge roller 43.

Figure 3:
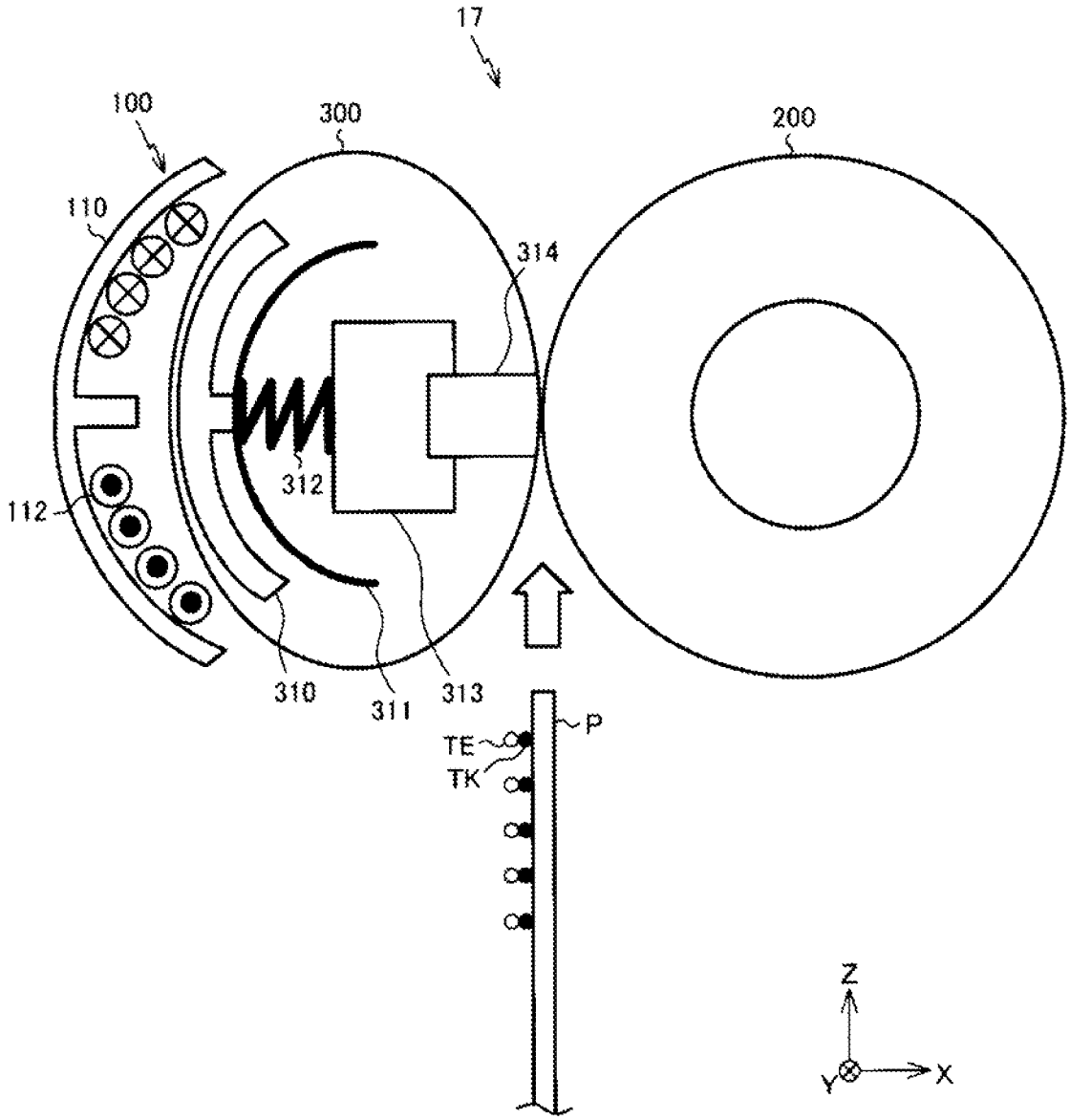
FIG. 3 is a diagram which illustrates a configuration of a fixing device.

FIG. 3 is a diagram which illustrates a configuration of the fixing device 17. The fixing device 17 includes a pressing roller 200, a fixing belt 300, a heating unit 100, a pressing pad 314, a holding member 313, an aluminum member 311, a magnetic shunt member 310, and the like.

The fixing belt 300 is a cylindrical member of which a longitudinal direction is set to a Y axis direction, and a length thereof is larger than a width (dimension in Y axis direction) of the sheet P. The fixing belt 300 is a member of which a material is polyimide sleeve, for example. A metal layer, such as a Ni layer or a Cu layer, is formed on the outer side of the fixing belt 300. The fixing belt 300 is rotatably supported around the holding member 313.

The heating unit 100 is disposed on the −X side of the fixing belt 300. The heating unit 100 is provided with a core 110 formed of ferrite, and a coil 112. A magnetic flux is generated when a high frequency current flows in the coil 112. The fixing belt 300 is heated when the magnetic flux is interlinked with the Ni layer and the Cu layer of the fixing belt 300. In the heating unit 100, the core 110 functions as a shield. For this reason, the magnetic flux is generated only on the +X side of the coil 112.

The holding member 313 is a member of which a longitudinal direction is set to the Y axis direction. The holding member 313 is fixed in a state of being inserted into the fixing belt 300. The pressing pad 314 is fixed to the +X side of the holding member 313, and an elastic member 312 is fixed to the −X side of the holding member 313.

The pressing pad 314 is a member of which a longitudinal direction is set to the Y axis direction. The pressing pad 314 is formed of a phenol resin with a heat-resisting property, and the holding member 313 is held inside the fixing belt 300. A face on the +X side of the pressing pad 314 is shaped in a curved shape which goes along a face in the inside of the fixing belt 300.

The elastic member 312 is a pressing spring for example, and of which a +X side end is fixed to the holding member 313. In addition, the magnetic shunt member 310 is attached to a −X side end of the elastic member 312 through the aluminum member 311 which is curved along the fixing belt 300.

The magnetic shunt member 310 is a member of which a size is the same as that of the coil 112. The magnetic shunt member 310 has a property of which a magnetic permeability decreases when a temperature thereof becomes a Curie point or more. For this reason, when a temperature of the fixing belt 300 rises to some extent, a magnetic flux which is interlinked with the fixing belt 300 decreases. In this manner, a temperature rise of the fixing belt 300 is suppressed.

The pressing roller 200 is provided with a metal core of which a longitudinal direction is set to the Y axis direction, a rubber layer which is stacked on the outer peripheral face of the core and the like. A length of the pressing roller 200 is approximately the same as that of the fixing belt 300. The pressing roller 200 is urged in a direction which goes toward the fixing belt 300 (−X direction) using an elastic member (not illustrated). In this manner, the pressing roller 200 is pushed to the pressing pad 314 through the fixing belt 300. Due to this, the surface of the pressing roller 200 and the surface of the fixing belt 300 come into close contact.

In the fixing device 17 which is configured as described above, when the pressing roller 200 is rotated by a rotation mechanism (not illustrated), the fixing belt 300 is driven. In addition, when a high frequency current is supplied to the coil 112 in this state, the fixing belt 300 is heated. The fixing belt 300 is heated up to a predetermined target temperature. The target temperature is different depending on a type or a specification of the image forming apparatus 1. For example, the target temperature is a temperature in which it is possible to fix a toner image formed on a sheet to the sheet.

Accordingly, in the image forming apparatus 1, when printing is performed using normal toner, the fixing belt 300 is heated up to a temperature which is the same as the fixing temperature T2 of the normal toner. In addition, when printing is performed using decolorable toner, the fixing belt 300 is heated up to a temperature which is the same as the fixing temperature T1 of the decolorable toner. When performing decoloring of an image which has been formed on the sheet p using decolorable toner, the fixing belt 300 is heated up to a temperature which is the same as the decoloring temperature T3 of the decolorable toner.

Figure 4:
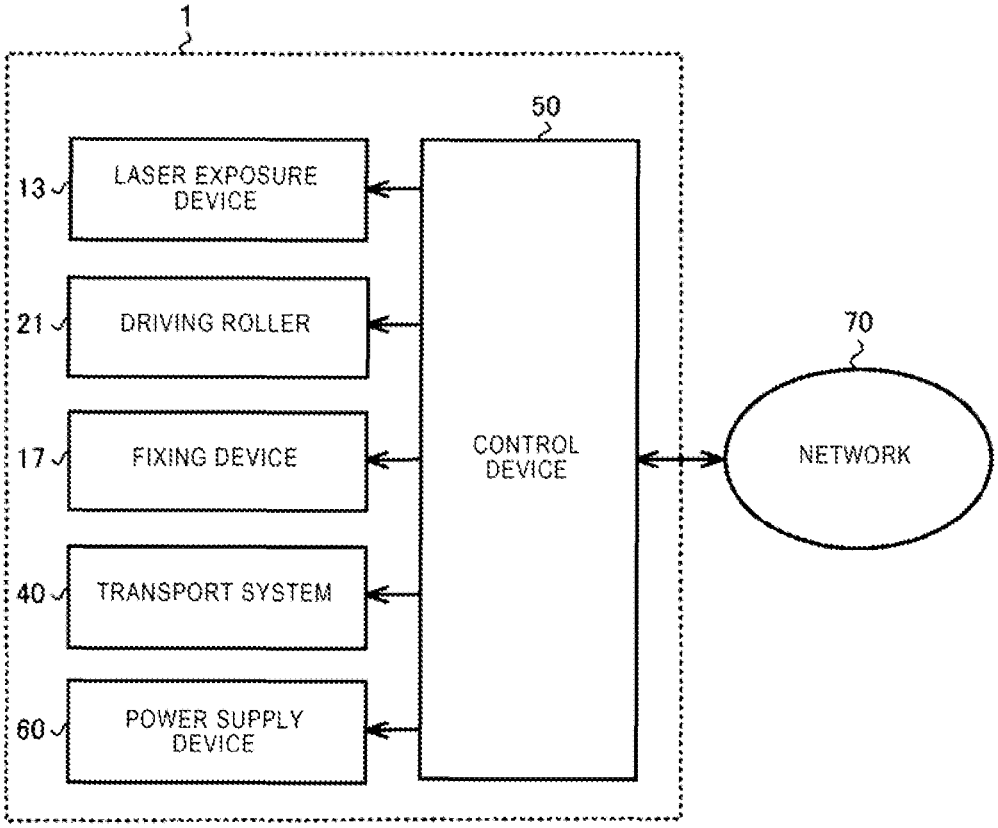
FIG. 4 is a block diagram which illustrates a control system of the image forming apparatus.

FIG. 4 is a flowchart which illustrates a control system of the image forming apparatus 1. The control device 50 controls the laser exposure device 13, the driving roller 21, the fixing device 17, the transport system 40, and a power supply device 60 which configure the image forming apparatus 1.

The power supply device 60 is used as a power supply of the fixing device 17, the charging devices 32 of the respective image forming stations 30E, 30Y, 30M, 30C, and 30K, or the like. The power supply device 60 supplies power to each unit based on an instruction of the control device 50.

The control device 50 is provided with a central processing unit (CPU), a main storage unit as a work area of the CPU, an auxiliary storage unit which includes a non-volatile memory, such as a magnetic disk or a semiconductor memory, a user interface including, for example, a graphical user interface (GUI) or a push button, an external interface including a LAN interface or a USB interface, or the like. The image forming apparatus 1 is connected to a network 70 through the control device 50. In this manner, it is possible to perform communicate with a terminal such as a personal computer which is connected to the network 70.

An operation of the image forming apparatus 1 will be described. The image forming apparatus 1 operates when the control device 50 executing a program, which is installed in advance, that refers to various parameters. Printing in the image forming apparatus 1 is selectively performed using normal toner or using decolorable toner.

In a printing in which normal toner is used, as illustrated in FIG. 1, the sheet P is extracted from the paper feeding cassette 10 by the pickup roller 42 and is then transported to a portion between the transfer belt 15 and the secondary transfer roller 23 using the resist roller 44.

At the image forming stations 30Y, 30M, 30C, and 30K, toner images are formed on the respective photoconductive drums 31 in parallel with the sheet feeding process. The toner images which are formed on the photoconductive drums 31 of each of the image forming stations 30Y, 30M, 30C, and 30K are then sequentially transferred to the transfer belt 15. In this manner, toner images formed of toner for yellow (Y), magenta (M), cyan (C), and black (K) are formed on the transfer belt 15.

The toner images formed on the transfer belt 15 are transferred to the sheet P as the sheet P passes the transfer belt 15 and the secondary transfer roller 23. In this manner, toner images formed of toner of yellow (Y), magenta (M), cyan (C), and black (K) are formed on the sheet P.

The toner images formed on the sheet P are fixed to the sheet P when the sheet P passes through the fixing device 17. In this manner, a printed image is formed on the sheet P. The sheet P is then discharged to the paper discharge unit, which is formed in the housing 4, using the paper discharge roller 43.

In a printing in which decolorable toner is used, the sheet P is extracted from the paper feeding cassette 10 using the pickup roller 42 and is then transported to the portion between the transfer belt 15 and the secondary transfer roller 23 using the resist roller 44.

A toner image is formed on the photoconductive drum 31 of the image forming station 30E, in parallel with the sheet feeding operation. The toner image formed on the photoconductive drum 31 of the image forming station 30E is then transferred to the transfer belt 15. In this manner, a toner image formed of blue (E) decolorable toner is formed on the transfer belt 15.

The toner image formed on the transfer belt 15 is then transferred to the sheet P as the sheet P is transported between the transfer belt 15 and the secondary transfer roller 23. In this manner, a toner image of a single color, blue (E), is formed on the sheet P.

This toner image formed on the sheet P is fixed to the sheet P when the sheet P passes through the fixing device 17. In this manner, a printed image is formed on the sheet P. The sheet P is then discharged to the paper discharge unit, which is formed in the housing 4, using the paper discharge roller 43.

In the image forming apparatus 1, position adjusting processing can be performed by an operator when the above described operation is performed. The position adjusting processing is matching a printed region R2 in which the toner image is actually printed with an intended, target printed region R1, which is regulated on the sheet P in advance.

Figure 5:
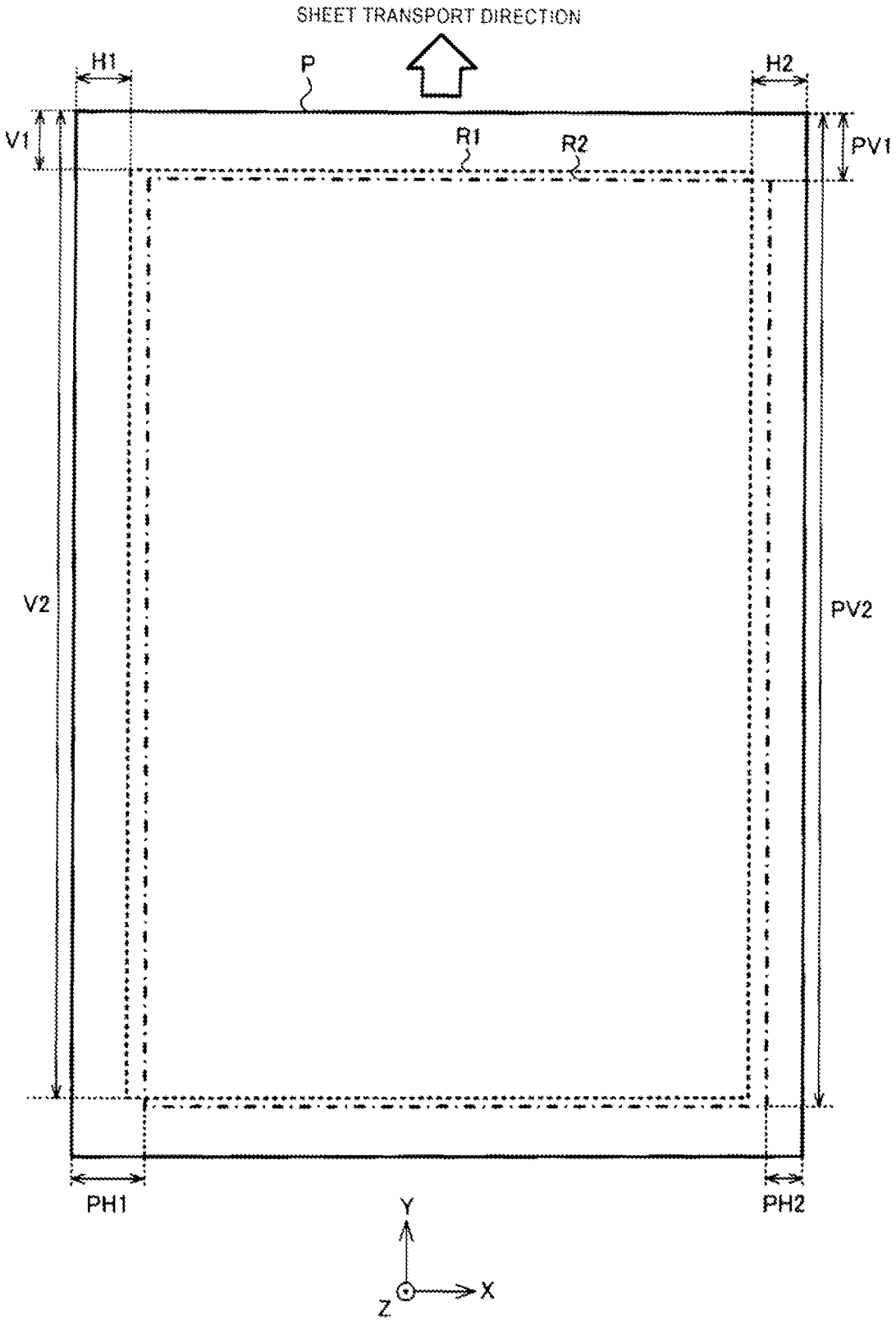
FIG. 5 is a diagram which illustrates a target printed region which is defined in a sheet, and a printed region in which a toner image is actually printed.

FIG. 5 is a diagram which illustrates the target printed region R1 which is regulated on the sheet P, and the printed region R2 in which a toner image is actually printed. As illustrated in FIG. 5, for example, the target printed region R1 is regulated by distances V1 and V2 from the upper end of the sheet P, a distance H1 from a left end, and a distance H2 from a right end of the sheet P. Meanwhile, the printed region R2 is regulated by parameters PH1, PH2, PV1, and PV2 corresponding to the distances H1, H2, V1, and V2.

In the position adjusting processing, the target printed region R1 and the printed region R2 are matched by adjusting a value of each parameter PH1, PH2, PV1, and PV2 based on the printing of a test pattern TP having a size that is the same as the printed region R2 which is regulated by the parameter PH1, PH2, PV1, and PV2.

Figure 6:
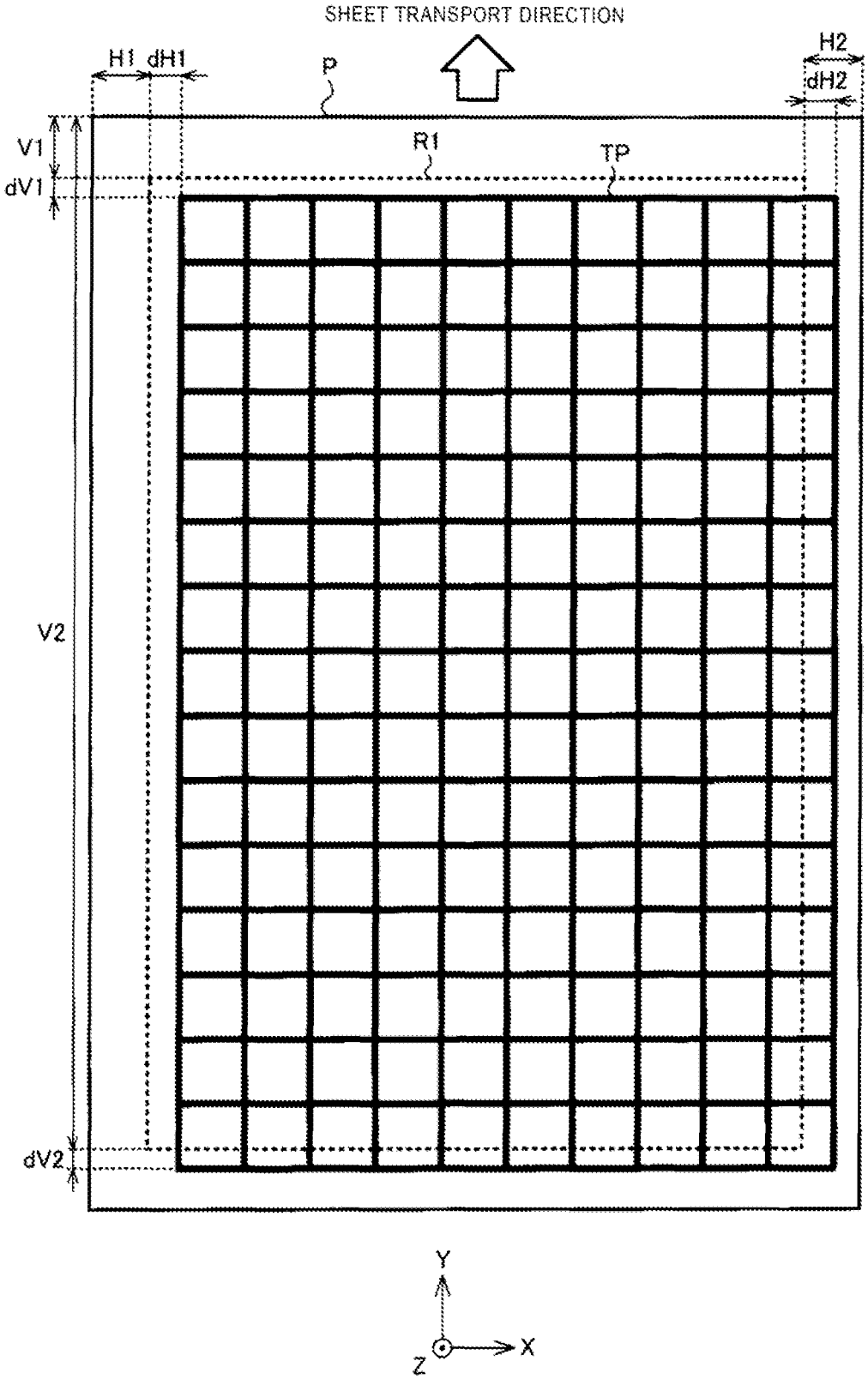
FIG. 6 is a diagram which illustrates an example test pattern printed on a sheet.

FIG. 6 is a diagram which illustrates an example of the test pattern TP printed on the sheet P. This test pattern TP example is a pattern including a line pattern, which is parallel to the X axis, and a line pattern which is parallel to the Y axis. An arrangement pitch of the line pattern in the X axis direction and the line pattern in the Y axis direction is approximately 10 mm.

As illustrated in FIG. 6, when there is a positional error between the target printed region R1 and the test pattern TP, the value of each parameter PH1, PH2, PV1, and PV2 is then adjusted based on the distances H1, H2, V1, and V2, which regulate an outer edge of the target printed region R1, and distances dH1, dH2, dV1, and dV2 between the outer edge of the target printed region R1 and an outer edge of the test pattern TP. In this position adjusting processing, printing of the test pattern, and adjusting of the parameter are repeated until the distances dH1, dH2, dV1, and dV2 become less than or equal to some predetermined threshold value(s), for example.

Figure 7:
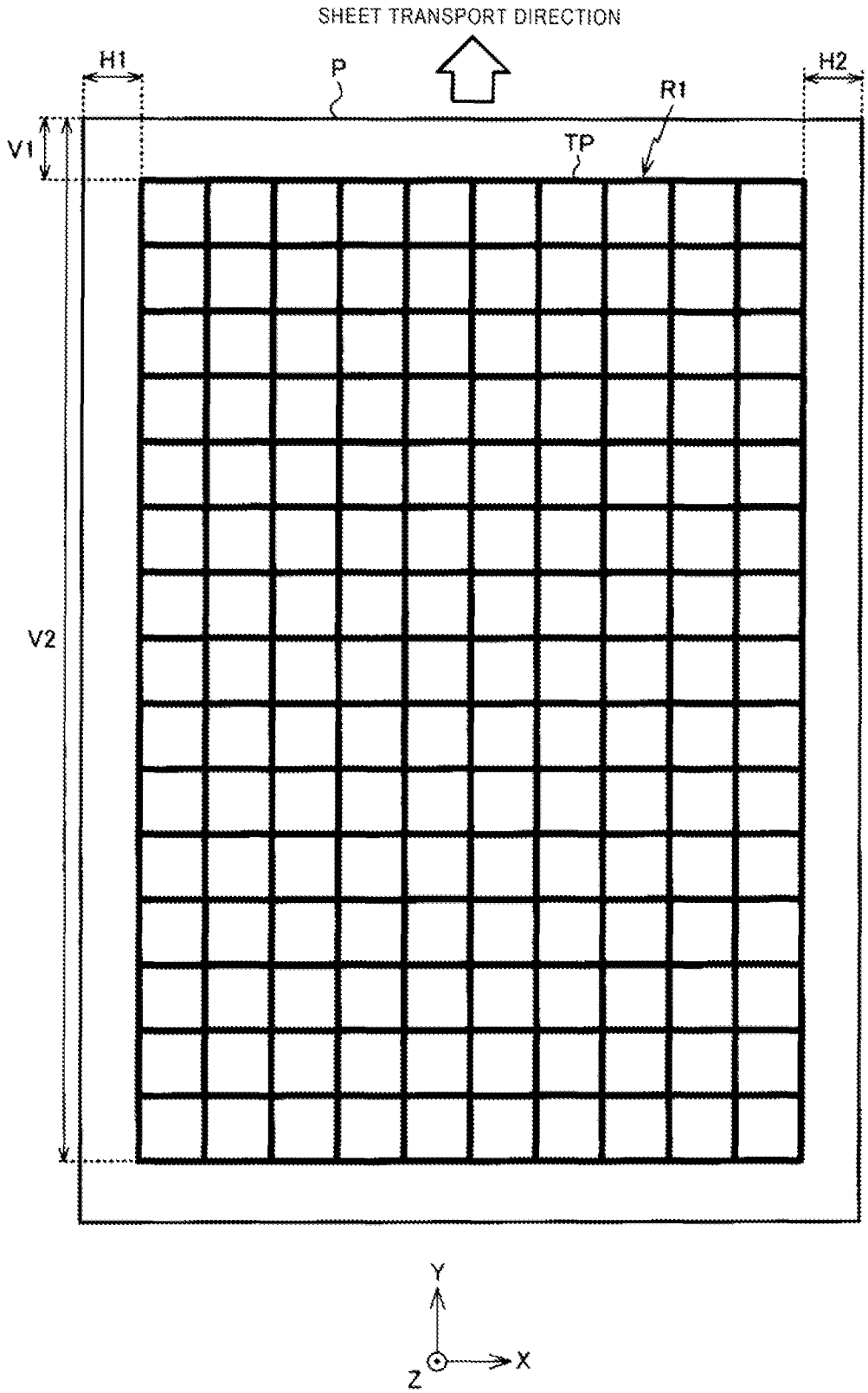
FIG. 7 is a diagram which illustrates another example test pattern printed on the sheet.

When the position adjusting processing has been completed, as illustrated in FIG. 7, the test pattern TP position and the target printed region R1 substantially match. The above described position adjusting processing can be performed for each of the image forming stations 30E, 30Y, 30M, 30C, and 30K.

When the position adjusting processing for each of the image forming stations 30E, 30Y, 30M, 30C, and 30K is completed, a further adjustment processing is performed for adjusting the parameters PH1, PH2, PV1, and PV2 of the control device 50 so that test patterns TPy, TPm, TPc, and TPe (respectively configured of toner images formed by the image forming stations 30E, 30Y, 30M, and 30C) are overlapping with a test pattern Tpk (which is formed by the image forming station 30K), for example.

Figure 8:
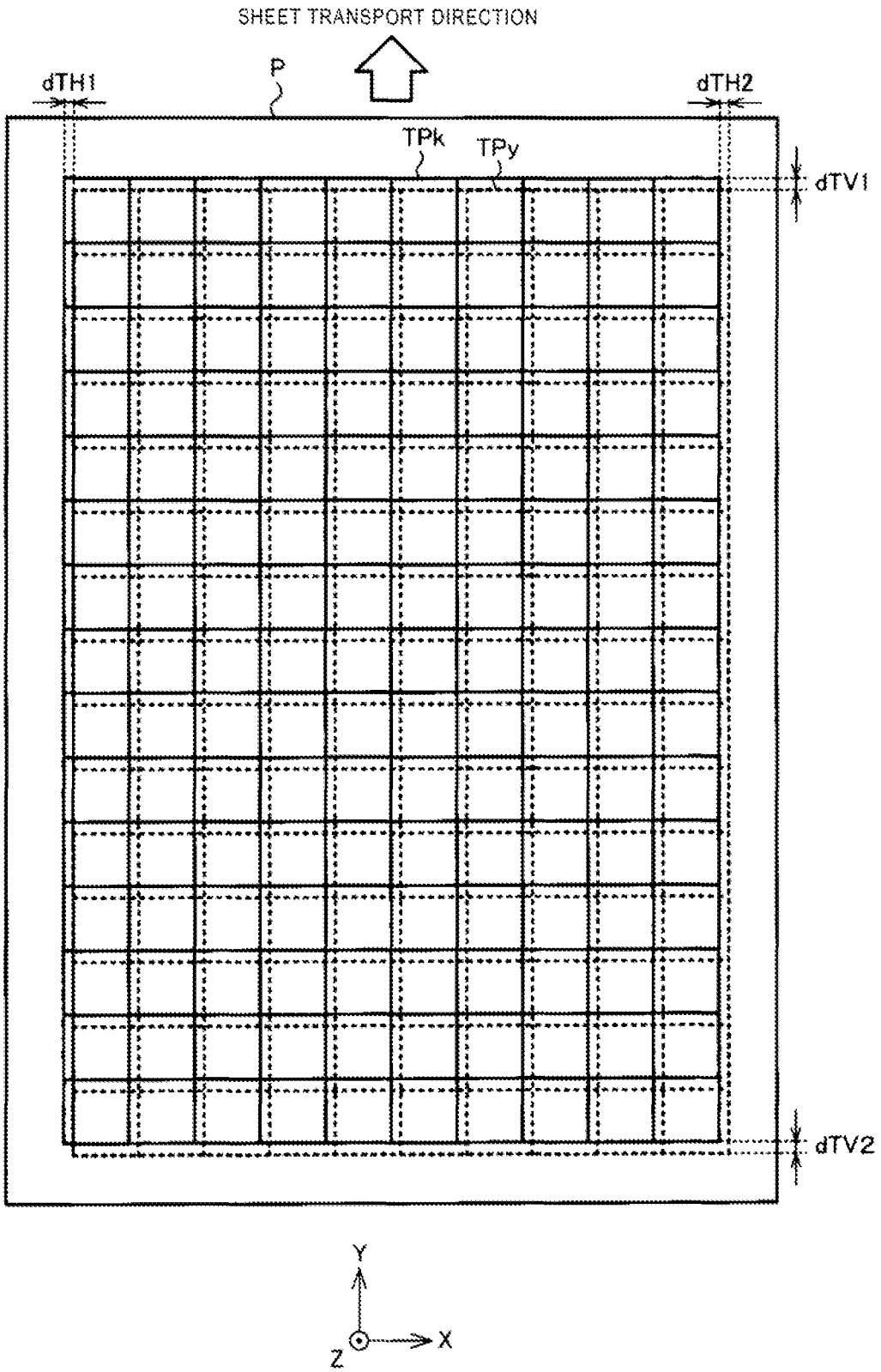
FIG. 8 is a diagram which illustrates yet another example of test pattern printed on the sheet.

In this adjustment processing for the image forming station 30Y, the test patterns TPk and TPy are printed on the sheet P, as illustrated in FIG. 8, using the image forming stations 30K and 30Y. When there is a positional (overlay) error between the test patterns TPk and TPy there is a shifting of an outer edge of the test pattern TPk and an outer edge of the test pattern TPy. Therefore, the values of parameters PH1, PH2, PV1, and PV2 of the image forming station 30Y are now adjusted based on differences dTH1, dTH2, dTV1, and dTV2 between the outer edge of the test pattern TPk and the outer edge of the test pattern TPy in a printed sample result. In this overlay adjustment processing, printing of test patterns and adjusting of parameter values are repeated until the differences dTH1, dTH2, dTV1, and dTV2 become less than or equal to a threshold value. When the adjustment is completed, the test pattern TPk and test pattern TPy will be substantially overlapping when printed. For adjustment processing of the other image forming stations 30M and 30C, the above described process described for image forming station 30Y is similarly used. In this manner, toner images formed by the image forming stations 30Y, 30M, 30C, and 30K are accurately overlapping on the sheet P.

Figure 9:
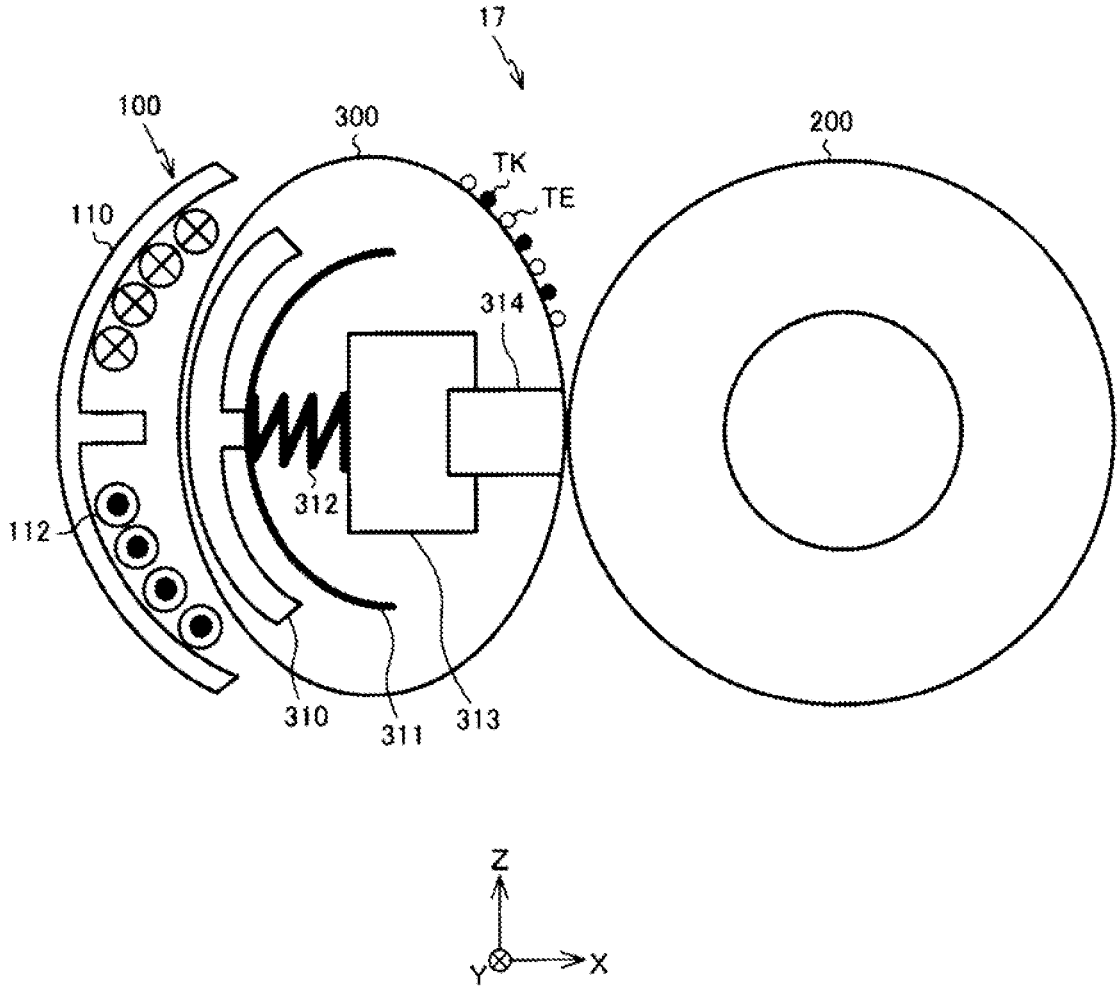
FIG. 9 is a diagram which illustrates toner attached to a fixing belt.

However, fixing temperatures of decolorable toner (from the image forming station 30E) and normal toner (from the image forming station 30K) are different. For this reason, fixing of then toner in the adjusting processing for the image forming station 30E is performed by heating the sheet P at the fixing temperature T1 of decolorable toner. But the fixing temperature T2 of the normal toner is higher than the fixing temperature T1 of the decolorable toner. For this reason, the normal toner might not be sufficiently fixed to the sheet P, and thus might be attached to the surface of the fixing belt 300 of the fixing device 17. For example, as illustrated in FIG. 3, when normal toner TK and decolorable toner TE are both used to form a toner image of the sheet P and this toner image subjected to the fixing temperature T1, as illustrated in FIG. 9, the toner TK and TE are adhered to the surface of the fixing belt 300.

Figure 10:
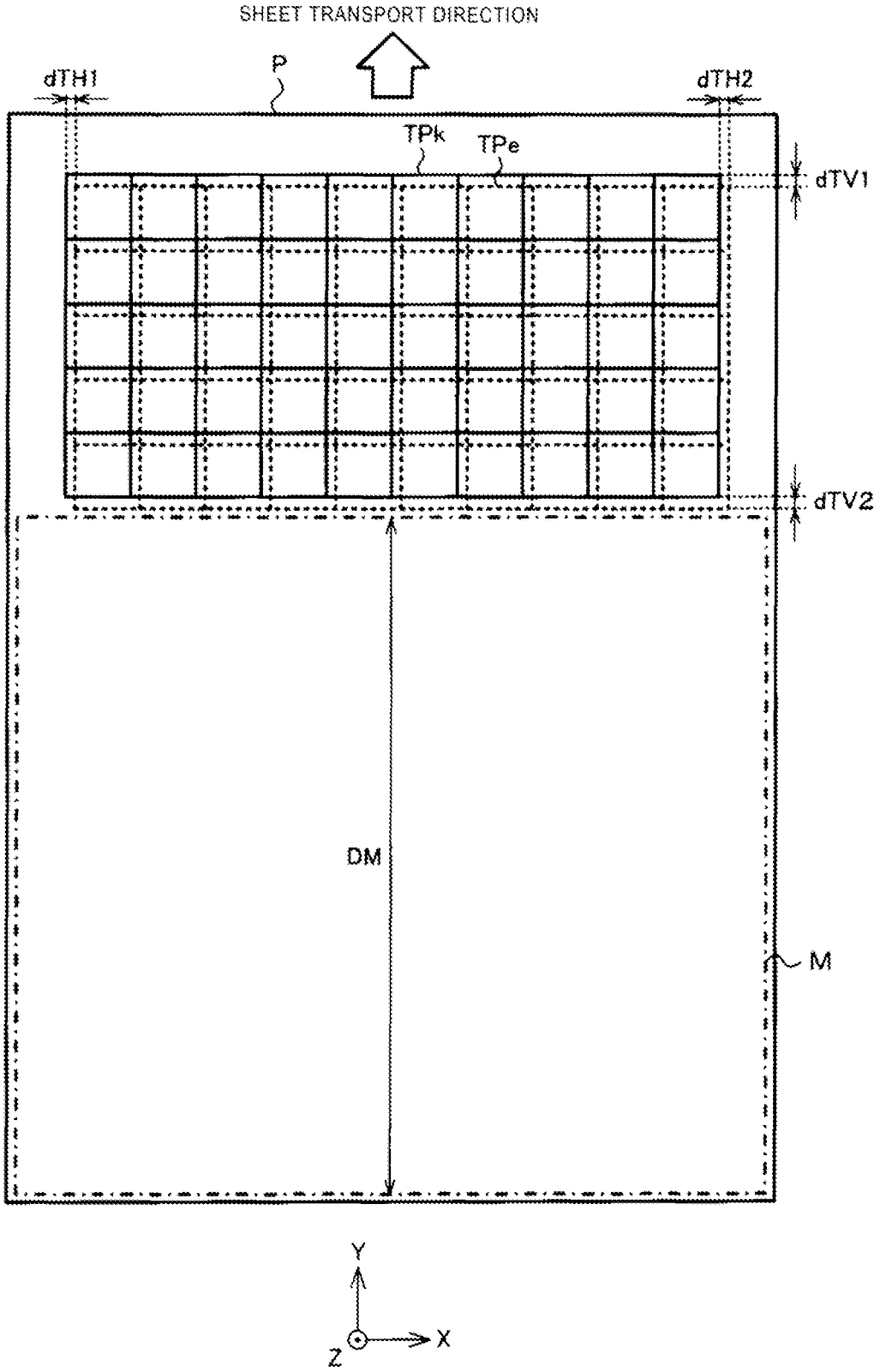
FIG. 10 is a diagram which illustrates a still yet another test pattern printed on the sheet.

Therefore, in the adjustment processing of the image forming station 30E, as illustrated in FIG. 10, a margin M for which a length along the transport direction is DM is formed on the upstream side of the sheet P by printing the test patterns TPe and TPk only at a tip end (leading end) portion of the sheet P along the transport direction. A value of DM is at least a length of the fixing belt 300 at its outer periphery in the fixing device 17.

When a length of the sheet P in the transport direction is short, there may be a case in which it is difficult to secure a sufficient margin M in the test printing process. In such a case, the region in which a test pattern is printed is set to be smaller so that the length DM of the margin M becomes at least equal to the outer circumferential length of the fixing belt 300.

When there is a positional error between the test patterns TPk and TPe, the outer edge of the test pattern TPk and the outer edge of the test pattern TPe are shifted with respect to each other. Therefore, the value of parameters PH1, PH2, PV1, and PV2 of the image forming station 30E are adjusted, based on the differences dTH1, dTH2, dTV1, and dTV2 between the outer edge of the test pattern TPk and the outer edge of the test pattern TPe. In the adjustment processing, printing of the test pattern and adjusting of the value of the parameter are repeated until the differences dTH1, dTH2, dTV1, and dTV2 become equal to or less than a threshold value. When the positioning adjusting processing has been completed the test patterns TPk and TPe will be printed in an overlapping state.

Figure 11:
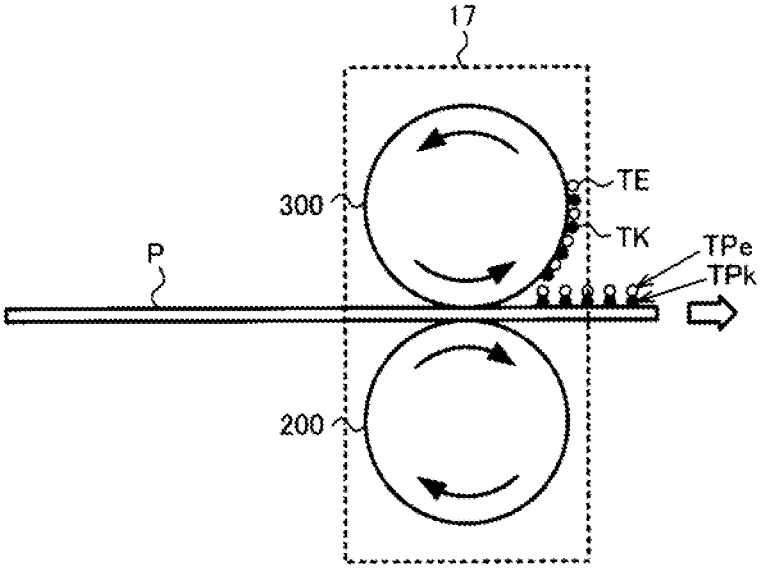
FIG. 11 is a diagram which describes a movement of toner attached to the fixing belt to a sheet.
Figure 12:
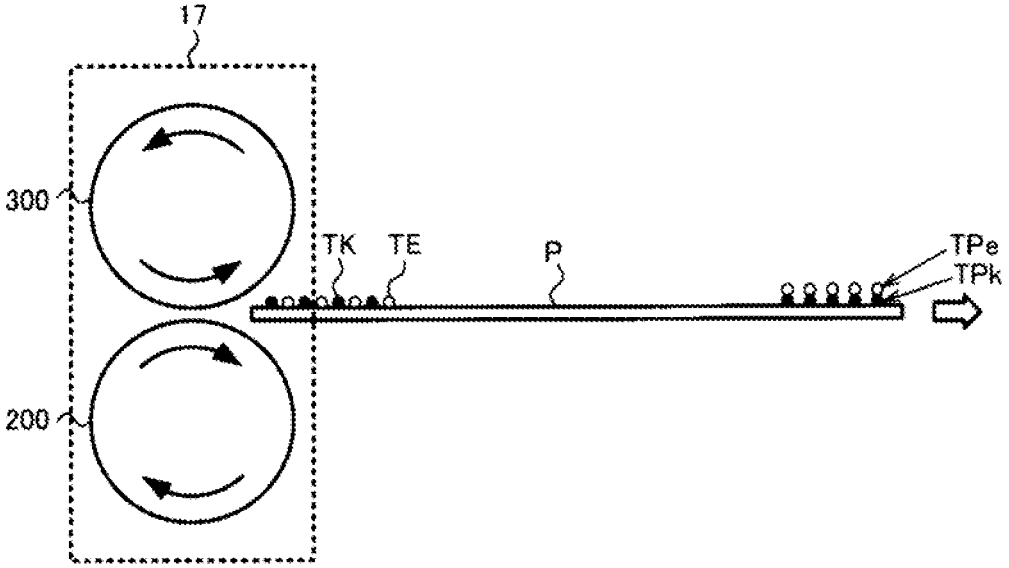
FIG. 12 is a diagram which describes a movement of toner attached to the fixing belt to a sheet.

In addition, in the positioning adjusting processing of the image forming station 30E, as illustrated in the conceptual diagram in FIG. 11, toner TK and toner TE of the test patterns TPk and TPe are attached to the surface of the fixing belt 300; however, the toner TK and toner TE attached to the surface of the fixing belt 300 transfer to the sheet P, as illustrated in FIG. 12, when the margin M of the sheet P passes through the fixing device 17. In this manner, contamination due to toner on the fixing belt 300 is reduced.

As described above, according to the embodiment, a margin is provided on the upstream side of the sheet P in the transport direction when a test pattern is formed, using toners having different fixing temperatures from one another. For this reason, even when toner is attached to the fixing belt 300 (because of insufficient fixing of toner of one side) the toner of the fixing belt 300 transfers to a margin region of the sheet P when the margin M of the sheet P passes through the fixing belt 300. For this reason, it is possible to suppress a deterioration in printing quality which might otherwise be caused by contamination of the fixing belt 300.

In particular, when forming a test pattern configured of both a toner image using decolorable toner and a toner image using normal toner, the fixing of the normal toner would typically be insufficient since a fixing temperature of the decolorable toner is lower than a fixing temperature of the normal toner. Likewise, by increasing a fixing temperature in order to sufficiently fix the normal toner, the decolorable toner would be decolored. According to this embodiment, it is possible to print a test pattern using decolorable toner and a normal toner without decoloring the decolorable toner. For this reason, it is possible to accurately perform positioning adjusting processing using different toner types. In addition, even when there is toner for which fixing to the sheet P was insufficient still attached to the fixing belt of the fixing device 17, this toner is transferred to a margin M region of the sheet P by advancing the sheet P along the transport direction by the margin distance DM. For this reason, the fixing belt 300 is maintained at a clean state. Accordingly, even after printing a test pattern with a plurality of toner having different fixing temperatures, it is possible to form an image with high quality on the sheet P.

When an amount of toner attached to the fixing belt 300 is large, a blank sheet (white paper) on which printing is not performed may be discharged through the fixing device 17, as necessary to remove the toner attached to the fixing belt 300. By discharging blank paper through the fixing device 17, it is possible to remove toner attached to the fixing belt 300.

The possible embodiments of the present disclosure are not limited to the above described example embodiment. For example, as illustrated in FIG. 1, a case in which the image forming apparatus 1 is a color laser printer provided with the five image forming stations 30E, 30Y, 30M, 30C, and 30K was described. However, the image forming apparatus 1 may include only the image forming station 30K and the image forming station 30E, for example.

Figure 13:
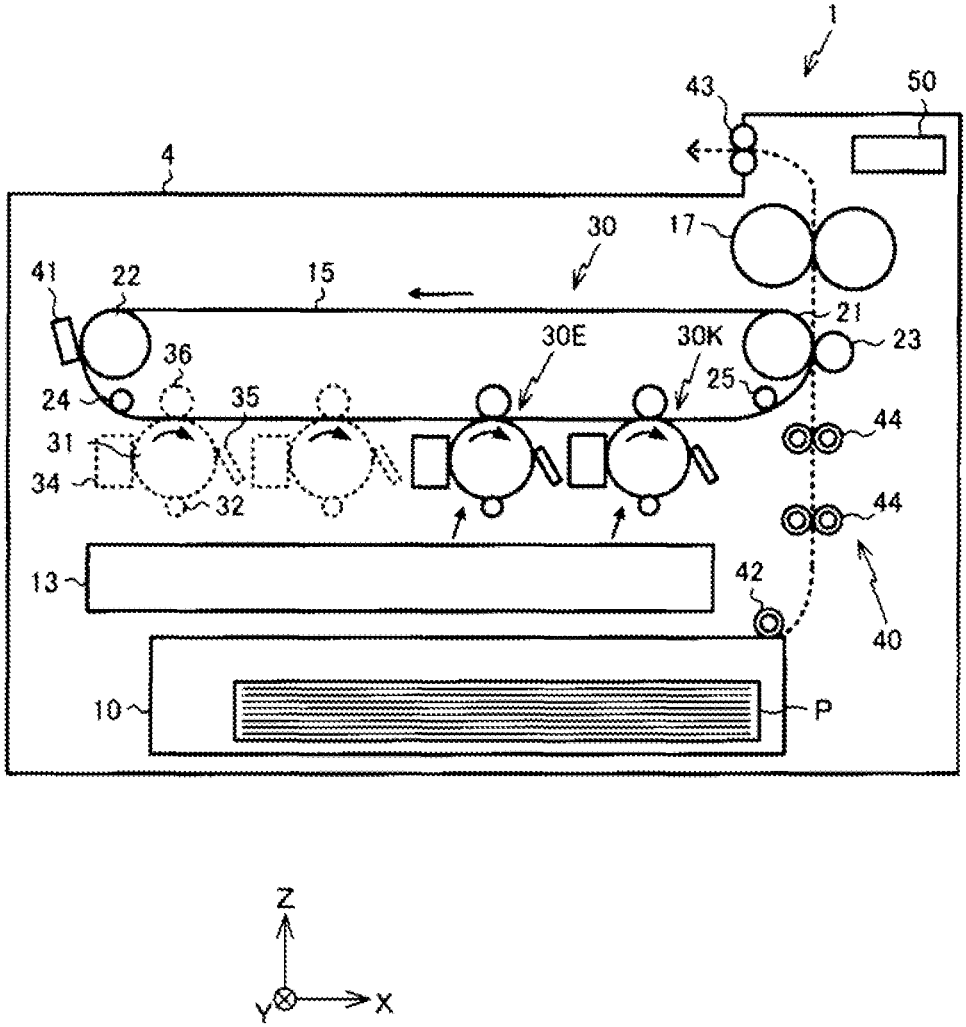
FIG. 13 is a diagram which illustrates a modification example of the image forming apparatus.

Also, as illustrated in FIG. 13, the image forming apparatus 1 may be include four image forming stations 30Y, 30M, 30C, and 30K, of which one of these four image forming stations uses decolorable toner. The image forming apparatus 1 specifically illustrated in FIG. 13 has the image forming station 30C changed to an image forming station 30E by supplying decolorable toner to this image forming station. In this manner, an image forming apparatus, which can perform color printing, may be used as an image forming apparatus in which decolorable toner and normal toner are used for different purposes.

As illustrated in FIG. 6, the test pattern TP is set to be configured of a line pattern which is arranged with intervals of 10 mm in the X axis direction and Y axis direction. However, the disclosure is not limited to this, and it is possible to use any arbitrary pattern as the test pattern TP.

The image forming apparatus 1 is provided with the transfer belt 15 as a transfer body. However, the disclosure is not limited to this, and the image forming apparatus 1 may instead be provided with a transfer drum, or the like, as the transfer body instead.

A fixing device 17 with a pressing roller 200 and the fixing belt 300 as the fixing member was described as an example. However, the disclosure is not limited to this configuration, and the fixing device 17 may be provided instead with a fixing roller, or the like, which is substituted with the fixing belt 300. Also in such a case, it is possible to maintain the fixing roller as the fixing member in a cleaner state in which there is no attached toner by forming a margin M which is continuous to the test patterns TPk and TPe on the sheet P.

As illustrated in FIG. 3, a case in which the decolorable toner TE is transferred to the sheet P through the normal toner TK was described as an example. However, the disclosure is not limited to this, and the normal toner TK may be transferred to the sheet P through the decolorable toner TE.

A case in which the image forming apparatus 1 is a laser printer was described as an example. However, the disclosure is not limited to this, and the image forming apparatus 1 may be and/or incorporate a multifunction peripheral device having a scanner, a fax machine, or the like, in addition to printer functions.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. An image forming apparatus, comprising:

a first toner image forming unit configured to form a first toner image on a transfer belt using a first toner that fixes at a first temperature;

a second toner image forming unit configured to form a second toner image on the transfer belt using a second toner that fixes at a second temperature that is different from the first temperature;

a secondary transfer unit configured to transfer the first and second toner images from the transfer belt to a sheet traveling in a sheet transport direction;

a fixing unit configured to fix the first and second toner images to the sheet traveling in the sheet transport direction; and a control unit configured to:

control the first toner image forming unit to form the first toner image in a first pattern on the transfer belt, control the second toner image forming unit to form the second toner image in a second pattern on the transfer belt overlapping the first pattern, and control the secondary transfer unit to transfer the first pattern and the second pattern onto the sheet while leaving a margin on a upstream side of the sheet in the sheet transport direction, a length of the margin in the sheet transport direction being greater than or equal to a circumferential distance of a fixing element in the fixing unit, wherein the first toner is toner which can be decolored by heating to greater than the second temperature, and the control unit is configured to generate the first pattern and the second pattern, and the first and second patterns are test patterns for evaluating alignment between the first image forming unit and the second image forming unit.

2. The apparatus according to claim 1, wherein the fixing element is a belt.

3. The apparatus according to claim 1, wherein the fixing element rotates about an axis that is orthogonal to the sheet transport direction, and the first and second patterns are pressed on to the sheet by the fixing element.

4. The apparatus according to claim 1, wherein the first temperature is lower than the second temperature, and the control unit controls a temperature of the fixing unit to be between the first temperature and the second temperature.

5. An image forming method for an image forming apparatus, the method comprising:

with a first toner image forming unit of the image forming apparatus, forming a first toner image on a transfer belt using a first toner that fixes at a first temperature;

with a second toner image forming unit of the image forming apparatus, forming a second toner image on the transfer belt using a second toner that fixes at a second temperature from the first temperature;

with a secondary transfer unit, transferring the first and second toner images from the transfer belt to a sheet traveling in a sheet transport direction;

with a fixing unit, fixing the first and second toner images to the sheet traveling in the sheet transport direction;

evaluating an alignment of a first pattern relative to a second pattern; and adjusting at least one parameter of at least one of the first and second toner image forming units according to the evaluation of the alignment of the first pattern relative to the second pattern, wherein the first toner image forms the first pattern on the transfer belt, the second toner image forms the second pattern on the transfer belt, and the first and second patterns are transferred to the sheet while leaving a margin on a upstream side of the sheet in the sheet transport direction that is greater than or equal to a circumferential distance of a fixing element in the fixing unit.

6. The method according to claim 5, wherein the fixing element is a belt.

7. The method according to claim 5, wherein each of the first and second patterns are line and space patterns.

8. The method according to claim 5, wherein the first temperature is lower than the second temperature, and the fixing unit is set to a temperature between the first and second temperatures during the fixing of the first and second toner images.

9. The method according to claim 5, wherein the first toner is a decolorable toner having a decoloring temperature higher than the second temperature.

10. The method according to claim 9, wherein the second toner is a non-decolorable toner.

11. The method according to claim 5, further comprising:

passing a blank sheet through fixing unit after the first and second patterns have been transferred to the sheet.

* * * * *